US006786228B2

(12) United States Patent
Pabst

(10) Patent No.: US 6,786,228 B2
(45) Date of Patent: Sep. 7, 2004

(54) AIR CIRCUIT WITH AIR ECONOMIZING AND MEMORY

(75) Inventor: William V. Pabst, Murfreesboro, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 63 days.

(21) Appl. No.: 10/268,529

(22) Filed: Oct. 9, 2002

(65) Prior Publication Data

US 2003/0116201 A1 Jun. 26, 2003

Related U.S. Application Data

(60) Provisional application No. 60/342,253, filed on Dec. 20, 2001.

(51) Int. Cl.[7] ..... E03B 5/00; A45J 45/00

(52) U.S. Cl. ..... 137/14; 137/487.5; 137/565.23; 417/187; 251/97

(58) Field of Search ..... 294/907, 64.2; 137/487.5, 565.23, 565.22, 14; 417/187; 251/297

(56) References Cited

U.S. PATENT DOCUMENTS

| | | | | | |
|---|---|---|---|---|---|
| 4,750,768 | A | | 6/1988 | Kumar | 294/64.1 |
| 4,961,441 | A | * | 10/1990 | Salter | 137/14 |
| 5,188,411 | A | * | 2/1993 | Golden | 294/64.2 |
| 5,201,560 | A | | 4/1993 | Golden | 417/187 |
| 5,277,468 | A | | 1/1994 | Blatt et al. | 417/187 |
| 6,397,876 | B1 | | 6/2002 | Golden et al. | |
| 6,397,885 | B1 | * | 6/2002 | Golden et al. | 294/64.2 |
| 6,443,175 | B1 | * | 9/2002 | Pabst | 137/14 |

* cited by examiner

*Primary Examiner*—A. Michael Chambers
(74) *Attorney, Agent, or Firm*—Ellis & Venable, P.C.

(57) ABSTRACT

The invention is summarized as a method and apparatus for providing a memory function for an air economizing fluid pressure circuit. A latchable or detented valve is used to control an air circuit that defaults to permit the generation of vacuum pressure, but is also cable of ceasing the generation of vacuum pressure generation to air economize. The invention may also include blow off capability for the air circuit.

15 Claims, 3 Drawing Sheets

AIR CIRCUIT WITH AIR ECONOMIZING AND MEMORY

This application claims priority from earlier filed provisional application Ser. No. 60/342,253 filed Dec. 20, 2001.

BACKGROUND OF THE INVENTION

1. Field of the Invention

The invention is applicable in the field of pneumatic air circuits.

2. Discussion of the Related Art

Fluid control valves are common in the art. ISO 1219-1 provides the symbology for fluid control valves. Fluid control valves are often combined in fluid or air pressure circuits to control the generation of negative pressure (i.e. vacuum pressure) by porting positive fluid pressure through a Venturi vacuum generator. Vacuum pressure is used in many industrial pick-and-place applications to manually or automatically maneuver heavy or awkward pieces. If follows that control systems are designed to assist the use of vacuum pressure in such industrial applications.

FIG. 1A illustrates a prior art pressure control circuit with air-economizing capability. A Master Control Valve 8 has two states selectable either by an electrical or a mechanical actuator, an input port coupled to a Positive Pressure Source ("P"), and an output port. A Venturi Vacuum generator 14 has a input port, which is coupled to the output port of the Master Control Valve 8. The Venturi Vacuum generator 14 also has an exhaust port, to which a silencer is attachable, and a vacuum output port. The vacuum output port is coupled to a check valve 7, which allows only unidirectional fluid flow, and a filter 17 ultimately providing an air circuit output ("V") suitable for attaching a suction head for use in industrial applications, such as pick-and-place applications. Air-economizing is provided by a pressure switch 19, which includes an electronic pressure sensor and that provides electronic feedback to the electronic actuator of the Master Control Valve 8.

During normal operating conditions, the prior art air circuit output pressure at V exhibits characteristics depicted in FIG. 1B. The Master Control Valve 8 state is toggled "on" ($t=t_0$) to generate vacuum pressure at V (segments "A" & "B"). Eventually, due to imperfections in the air circuit including the seal between the suction head and the work piece, the vacuum pressure decreases at "V" until reaching the "Trip Pressure" of the electronic pressure sensor 19 (segment "C"). When the pressure switch 19 detects that the vacuum pressure at "V" has reached the "Trip Pressure", the pressure switch 19 output toggles the actuator of the Master Control Valve 8 and the vacuum pressure at "V" is restored (represented by segment "D"). Operation continues as illustrated in FIG. 1B until the work piece is to be release, then Blow off may be provided by additional air circuit components not illustrated in FIG. 1A.

An inherent problem of the type of control system illustrated in FIG. 1A is the dependency on electricity for software or hardware functions. More particularly, in the event of a power loss to the system, the work piece will eventually be dropped as the vacuum pressure at V diminishes beyond that required to lift the work piece and the pressure switch 19 output fails to toggle on the Master Control Valve 8. The air circuit characteristics are presented in graphical form in FIG. 1B. Thus, a problem may exist if electrical power is lost to a control system being used to maneuver a valuable item, particularly if the loss of electrical power affects a loss of generated vacuum pressure and the valuable item will be dropped.

SUMMARY OF THE INVENTION

The invention is summarized as a method and apparatus for providing a memory function for an air economizing fluid pressure circuit. A latchable or detented valve is used to control an air circuit that defaults to permit the generation of vacuum pressure, but is also cable of ceasing the generation of vacuum pressure generation to air economize. The invention may also include blow off capability for the air circuit.

DESCRIPTIONS OF EMBODIMENTS

The descriptions that follow are intended to aid in the understanding but not limit the actual scope of the claimed invention. The scope of the invention is fully captured by the claims that follow this description.

Figure 1A:
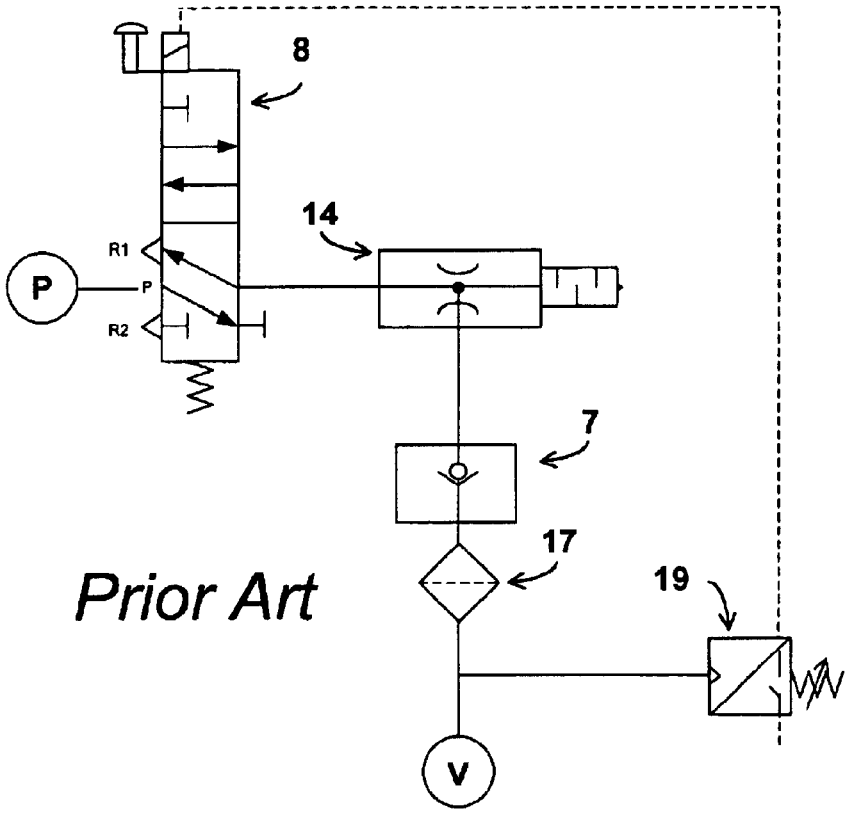
FIG. 1A illustrates a prior art air circuit.
Figure 1B:
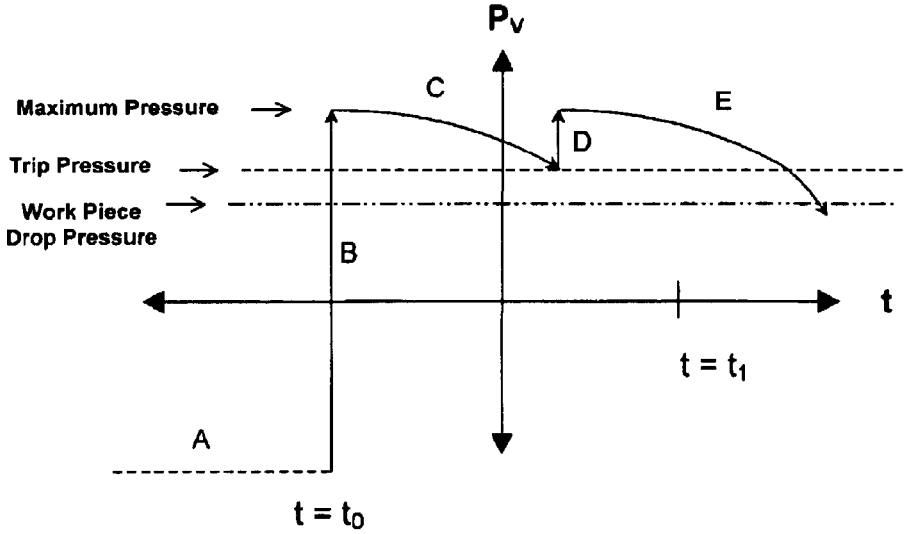
FIG. 1B illustrates air circuit characteristics of the prior art circuit.
Figure 2A:
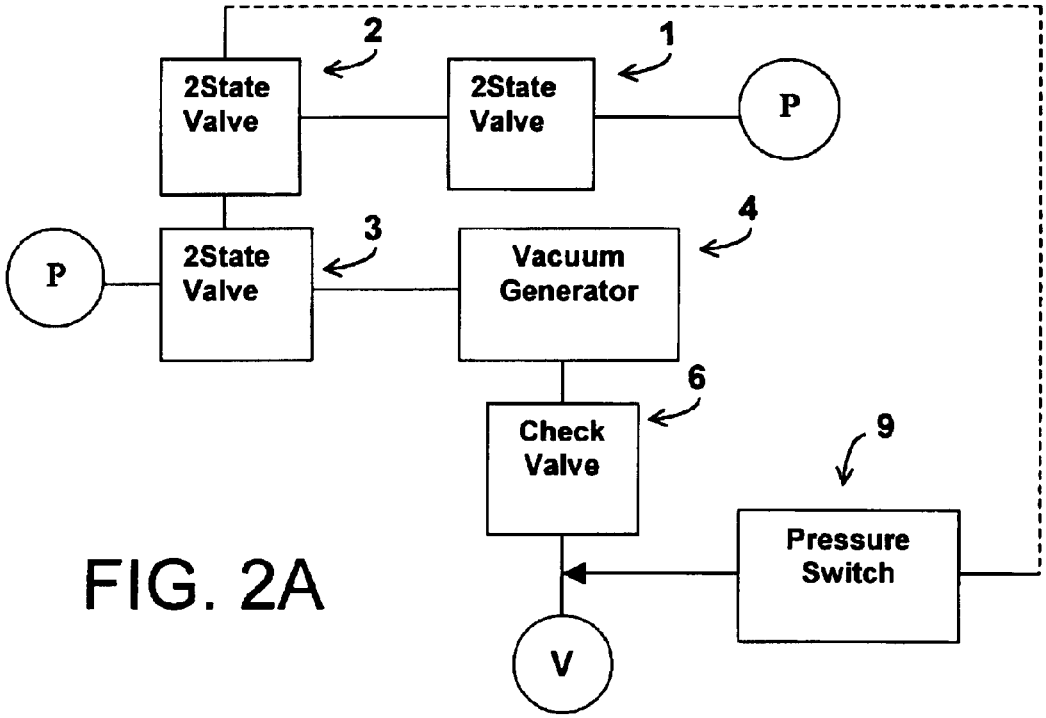
FIG. 2A illustrates air circuit output characteristics of the first embodiment of the invention.

FIG. 2A illustrates a basic block diagram of an embodiment of the invention. A Venturi style vacuum generator 4 is coupled to Valves 1, 2, & 3, which are fluid control valves that deter fluid control in one state but permit fluid flow in a second state. It is to be understood that while two state valves are described herein, it is also possible to use three state valves and greater to implement the embodiments described herein. "P" represents a positive pressure source and "V" represents the air circuit output. A suction head is coupled to the air output V for pick and place applications.

Valve 2 is a two state valve with an electronic actuator. The electronic actuator is ordinarily implemented using a solenoid integrated into the two state valve and having minimum input voltage and current conditions that will cause or "actuate" the two state valve to change states. The default state of Valve 2 is to allow fluid flow between the input port and the output port. Thus, the application of a sufficient electronic signal at the electronic actuator input will "toggle" Valve 2 to change fluid flow states and deter fluid flow between the input port and the output port.

Valve 3 is a two state valve with a pressure actuator. The pressure actuator is ordinarily integrated into the two state valve and has minimum input pressure condition that will actuate the two state valve to change states. The default state of Valve 3 is to deter fluid flow between the Valve 3 input and output ports. Thus, the application of a sufficient pressure at the pressure actuator input will "toggle" Valve 3 to change fluid flow states and allow fluid flow between the input port and the output port.

Vacuum generator 4 is a Venturi type vacuum generator. Venturi style generators are well known in the art and have an input port, an exhaust port, and a vacuum output port. The vacuum generator 4 input port is coupled to the Valve 3 output port and the vacuum generator 4 output port is coupled to the air circuit output V. A check valve 6 is coupled between the vacuum generator 4 output port and the air circuit output V. The check valve 6 permits only a unidirectional flow of air and aids in maintaining negative pressure at the air circuit output V. A pressure switch 9, with a pressure sense input coupled to the air circuit output V and an electrical output based upon the pressure sensed is coupled to the electrical actuator of Valve 2.

Valve 1 is a two state detented valve controlled by an actuator. The detented valve retains the set valve state unless the actuator is subsequently operated to overcome the previous setting of the detented valve. Thus, the default state for the detented valve is the last set state and it is to be understood that other types of valves having memory implemented by latches or other means are considered to be equivalents of the detented valve. The actuator of the detented valve may be at least one of either a mechanical, electrical, or pressure actuator. Detented valves with actuators are well known in the art as is the operation of such type valves. Detented valve 1 input port is coupled to the positive pressure source P and the detented valve 1 output port is coupled to the Valve 2 input port.

Figure 2B:
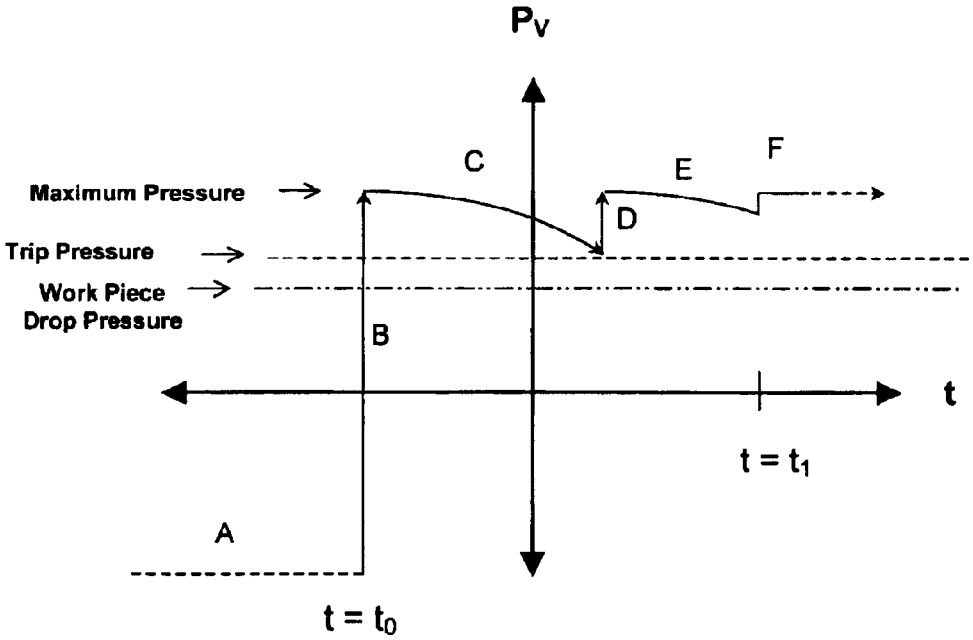
FIG. 2 illustrates a block diagram of a first embodiment of the invention

Operation of the air circuit of FIG. 2A is as depicted in FIG. 2B during normal operating conditions. Vacuum pressure at V is generated by setting Valve 1 "on" ($t=t_0$). When "on", positive pressure is ported through Valve 1 to the Valve 2 input port, which in turn ports the positive pressure to the pressure actuator of Valve 3. The actuation of Valve 3 ports pressure from the positive pressure source P to the vacuum generator 4 input. In turn, the vacuum generator 4 produces negative pressure at the vacuum generator 4 output (segment "A" & "B"). Air circuit output V pressure ("$V_P$") is sensed by the pressure sense input of the pressure switch 9.

The combined functions of valve 2 and the pressure switch 9 enable air economizing to be realized by the air circuit in FIG. 2A. Provided that the sensed pressure at the air circuit output V remains above the Trip Threshold, the pressure switch 9 will cause the electronic actuator of the electronically controllable two state valve 2 to deter fluid flow through the electronically controllable two state valve 2 thereby impeding the porting of positive pressure through Valve 3 and the generation of vacuum pressure by the vacuum generator 4. If however, the pressure switch detects that pressure sensed at the air circuit V has fallen below the Trip Threshold, the pressure switch electronic output will toggle the electronically controllable two state valve 2 again causing the generation of vacuum pressure at the air circuit output V (segment "D"). It is contemplated that alternate pressure Trip Thresholds will be appropriate in different applications. Thus, it is preferable that the pressure switch 9 be designed or programmable to enable the toggling of the valve 2 actuator at alternate Trip Thresholds.

However, in contrast to prior art solutions, the current invention permits retention of the vacuum pressure at the air circuit output V in the event of an electrical power failure. In the event of an electrical power failure ($t=t_1$), the pressure switch 9 output will not toggle the actuator of Valve 2. However, the default condition of Valve 2 permits fluid flow. If detented Valve 1 is previously set "on" (permitting fluid flow), it will continue to port air pressure from P through Valve 2 to the Valve 3 pressure actuator and thereby permit the production of negative pressure at the vacuum generator 4 output and the air circuit output ("$V_P$") (segment F). Moreover, if Valve 1 is previously set "off" (deterring fluid flow), Valve 1 and Valve 2 will not port positive pressure to the actuator of Valve 2 and the vacuum generator 4 will continue to not produce vacuum pressure.

The air circuit in FIG. 2A represents only "single-sided" air economizing. In other words, vacuum generation is only initiated when a minimum vacuum pressure is reached. However, given the disclosure of this specification and the techniques disclosed herein, it would be within the knowledge of one of ordinary skill in the art to embody a "double-sided" air economizing air circuit by sensing at the air circuit output V and disabling vacuum generation if vacuum pressure exceeded a maximum threshold pressure.

Figure 3:
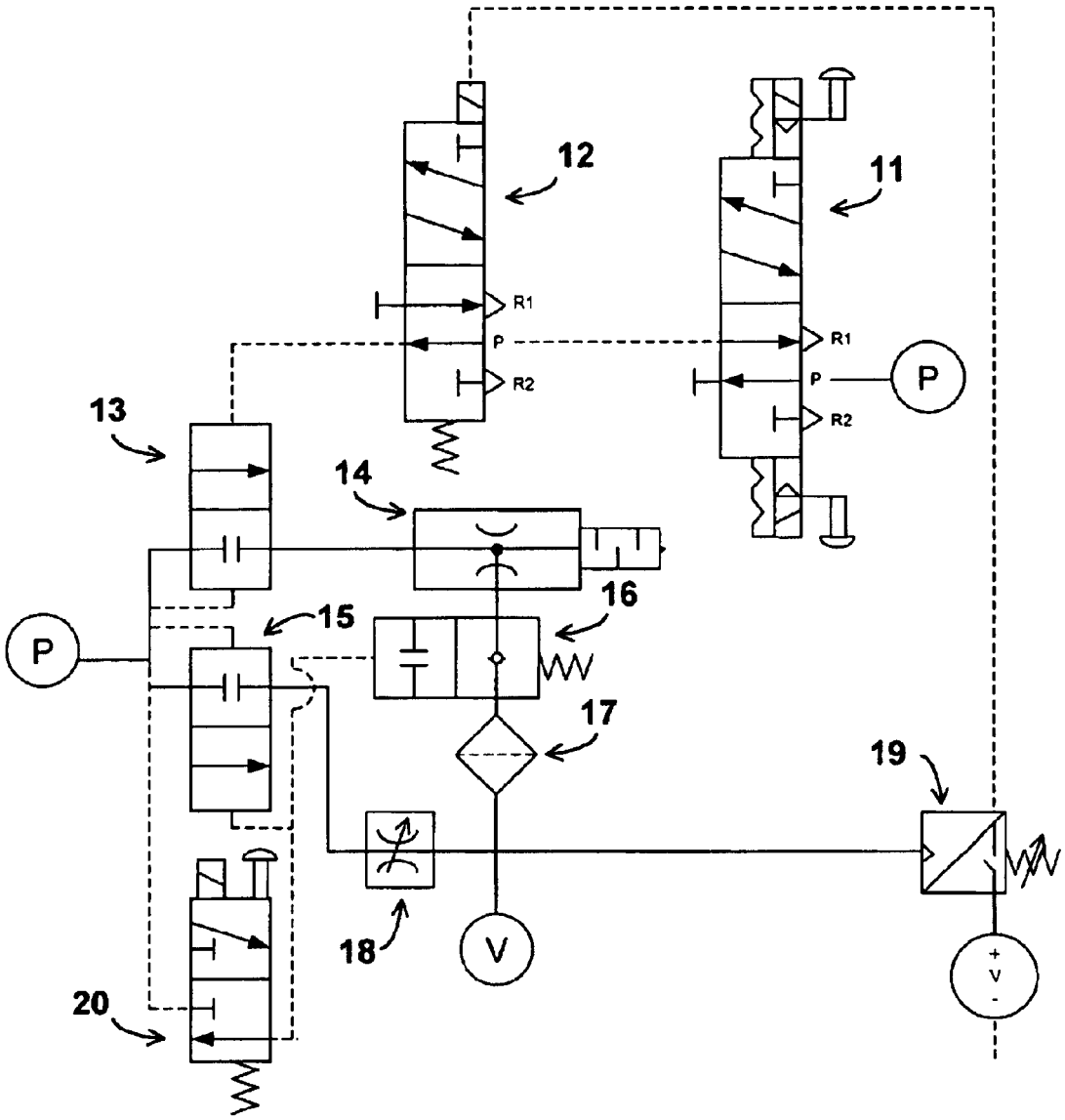
FIG. 3 illustrates a preferred embodiment of the invention.

A preferred embodiment implementing aspects of the invention is illustrated in FIG. 3. Further, the air circuit in FIG. 3 also includes "blow off" capability. Blow off capability indicates that positive pressure may introduced at the air circuit output V on command to release a work piece. The air circuit of FIG. 3 includes a Venturi type vacuum generator 14. A silencer is also attachable to the vacuum generator 14 exhaust port. Valve 2 is implemented by an electronically controllable two state valve 12 with at least a first electronic actuator, input and output ports, and a spring return to set the default state of the electronically controllable two state valve 12. The preferred default condition of Valve 2 is to permit fluid flow between the input and output ports. Valve 3 is implemented using a pressure controllable two state valve 13 with a pressure actuator, input and output ports, and a second pressure actuator input. The preferred default condition of the pressure controllable two state valve 13 is to deter fluid flow. Valve 1 is implemented using a detented two state valve 11 with at least one actuator selected from the group consisting of a mechanical actuator, an electrical actuator, and a pressure actuator. The detented two state valve 11 input port is coupled to the positive pressure source P and the detented two state valve 11 output port is coupled to the electronically controllable two state valve 12 input port. The electronically controllable two state valve 12 output port is coupled to the first pressure actuator input of the pressure controllable two state valve 13. The pressure controllable two state valve 13 input port is coupled to the positive pressure source P and the pressure controllable two state valve 13 output port is coupled to the input port of the vacuum generator 14. The pressure controllable two state valve 13 may be set in a default position by either a spring return (not shown) or by using a pressure controllable two state valve 13 with a second pressure actuator with input connected to the positive pressure source P.

Also included in the air circuit is a two state check valve 16 with input and output ports, a pressure actuator, and a spring return to garner the default condition of the two state check valve 16, which is preferably to permit fluid flow. The two state check valve 16 permits unidirectional fluid flow in one state and deters all fluid flow in a second state. The two state check valve 16 input port is coupled to the vacuum generator 14 vacuum output. The two state check valve 16 output port is coupled to a filter 17 and ultimately coupled to the air circuit output V. The functionality of the two state check valve 16 aids in the implementation of blow off capability.

Further aiding in the blow off capability is a two state valve 20. The two state valve 20 is controlled by at least one actuator selected from the group consisting of a mechanical actuator, an electrical actuator, and a pressure actuator. The two state valve 20 has an input port coupled to the positive pressure source P and the two state valve 20 output port is coupled to the pressure actuator of the two state check valve 16. Also included is a second pressure controllable two state valve 15 with input and output ports and pressure actuator. The preferred default condition of the pressure controllable two state valve 15 is to deter fluid flow. The second pressure controllable two state valve 15 may be set in a default position by either a spring return (not shown) or by using a pressure controllable two state valve with a second pressure actuator input connected to the positive pressure source P. An adjustable pressure regulator 18 is coupled between the second pressure controllable two state valve 15 output port and the air circuit output V to control the blow off pressure.

Normal operation of the air circuit in FIG. 3 is the same as that air circuit in FIG. 2A. Vacuum pressure at V is generated by setting detented two state valve 11 "on." When "on", positive pressure is ported through the detented two state valve 11 to the electronically controllable two state valve 12 input port, which in turn ports the positive pressure to the first pressure actuator input of the pressure controllable two state valve 13. The actuation of the pressure controllable two state valve 13 ports pressure from the positive pressure source P to the vacuum generator 14 input. In turn, the vacuum generator 14 produces negative pressure at the vacuum generator 14 output port. Air circuit output V pressure is sensed by the pressure sensor of the pressure switch 19. So long as the sensed pressure at the air circuit output V remains above the Trip Threshold, the pressure switch 19 will air economize using the electronic actuator of the electronically controllable two state valve 12 to deter fluid flow through the electronically controllable two state valve 12. If however, the pressure switch detects that pressure sensed at the air circuit V has fallen below the Trip Threshold, the pressure switch electronic output will toggle the electronically controllable two state valve 12 again causing the generation of vacuum pressure at the air circuit output V. Blow off functionality is initiated by toggling the two state valve 20 actuator, which in turn ports pressure to the pressure actuators of the second pressure controllable two state valve 15 and the two state check valve 16. Subsequently, the two state check valve 16 blocks fluid flow and the generation of vacuum pressure at the air circuit output V. Concurrently, the second pressure controllable two state valve 15 output ports positive air pressure through the pressure regulator 18 to the air circuit output V thereby causing a release of the work piece. Again, the air circuit in FIG. 3 also represents only single-sided air economizing. However, given the disclosure herein, it would be within the knowledge of one of ordinary skill in the art to sense a maximum pressure and disable vacuum generation if vacuum generation exceeded a maximum threshold pressure thereby embodying a "double-sided" air economizing air circuit.

Embodiments of the invention are described in the Drawings and Description of Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiments were chosen and described in order to best explain the principles of the invention and its practical application and to enable others skilled in the art to best utilize the invention in various embodiments and with various modifications as are suited to the particular use contemplated.

What is claimed is:

1. A method of controlling air pressure, comprising:

initiating fluid flow through a detented valve having retention capability of its last fluid flow state and through an electronically controllable valve coupled to a pressure actuator of a pressure controllable valve, thereby porting positive pressure through the pressure controllable valve to a vacuum generator;

sensing air pressure generated by the vacuum generator that is coupled to an air circuit output;

controlling the electronically controllable valve to deter fluid flow through the electronically controllable valve when the sensed air pressure generated by the vacuum generator reaches a threshold pressure.

2. The method in claim 1 further comprising the steps of;

initiating fluid flow through a second valve coupled to a positive pressure source to a pressure actuator of a two state check valve coupled to the vacuum generator output and a pressure actuator of a second pressure controllable valve coupled to a positive pressure source; thereby deterring fluid flow through the check valve; and permitting fluid flow through the second pressure controllable valve to the air circuit output.

3. The method in claim 2 further comprising the step of;

regulating the pressure of fluid flow reaching the air circuit output.

4. An air circuit, comprising:

a negative pressure generator, having a generator input port and a negative pressure port, a pressure controllable valve having, a pressure actuator, an input port coupled to a positive pressure source, and an output port coupled to the generator input port, the pressure actuator controlling the pressure controllable valve to deter fluid flow in a first state and permit fluid flow in a second state;

a detented valve having, at least one actuator, an input port coupled to a positive pressure source, and an output port, the at least one actuator controlling the detented valve to deter fluid flow in a first state and allow fluid flow in a second state;

an electronically controllable valve, having an electronic actuator, an input port coupled to the detented valve output port, and an output port coupled to the pressure actuator of the pressure controllable valve, the electronic actuator controlling the electronically controllable valve to allow fluid flow in a first state and deter fluid flow in a second state; and a pressure switch, having a pressure sense input coupled to the negative pressure port, and an electronic output coupled to the electronic actuator of the electronically controllable valve.

5. The air circuit in claim 4 wherein, the actuator of the detented two state valve is at least one of the actuators selected from the group consisting of; a mechanical actuator, an electrical actuator, and a pressure actuator.

6. The air circuit in claim 4 wherein, the pressure sense input is coupled to the negative pressure port by, a check valve added between the negative pressure port and the pressure sense input, the check valve providing unidirectional fluid flow from a check valve input port to a check valve output port, the check valve input port coupled to the negative pressure port and the check valve output port coupled to the pressure sense input.

7. The air circuit in claim 4 wherein, the pressure sense input is coupled to the negative pressure port by, a check valve having a check valve input port, a check valve output port, and a pressure actuator to allow unidirectional fluid flow in a first state, and deter fluid flow in a second state, the check valve added between the negative pressure port and the sensing port, wherein the check valve input port is coupled to the negative pressure port and the check valve output port is coupled to the pressure sensing port; the air circuit further comprising, a second pressure controllable valve having, a pressure actuator, an input port coupled to the positive pressure source, and an output port coupled to the negative pressure port; and a valve having, at least one actuator, an input port, and an output port, the input port coupled to the positive pressure source, the output port coupled to the pressure actuator of the check valve and the pressure actuator of the second pressure controllable valve.

8. The air circuit in claim 7 wherein, the output port of the second pressure controllable valve is coupled to the pressure sensing port by a pressure regulator.

9. The air circuit in claim 7 wherein, the actuator of the valve is selected from the group consisting of; a mechanical actuator, an electrical actuator, and a pressure actuator.

10. An air circuit, comprising:

a negative pressure generator, having a generator input port and a negative pressure port, a pressure controllable two state valve having, a pressure actuator, an input port coupled to a positive pressure source, and an output port coupled to the generator input port, the pressure actuator controlling the pressure controllable two state valve to deter fluid flow in a first state and permit fluid flow in a second state;

a detented two state valve having, at least one actuator, an input port coupled to a positive pressure source, and an output port, the at least one actuator controlling the detented two state valve to deter fluid flow in a first state and allow fluid flow in a second state;

an electronically controllable two state valve, having an electronic actuator, an input port coupled to the detented two state valve output port, and an output port coupled to the pressure actuator of the pressure controllable two state valve, the electronic actuator controlling the electronically controllable two state valve to allow fluid flow in a first state and deter fluid flow in a second state; and a pressure switch, having a pressure sense input coupled to the negative pressure port, and an electronic output coupled to the electronic actuator of the electronically controllable two state valve.

11. The air circuit in claim 10 wherein, the actuator of the detented two state valve is at least one of the actuators selected from the group consisting of; a mechanical actuator, an electrical actuator, and a pressure actuator.

12. The air circuit in claim 10 wherein, the pressure sense input is coupled to the negative pressure port by, a check valve added between the negative pressure port and the pressure sense input, the check valve providing unidirectional fluid flow from a check valve input port to a check valve output port, the check valve input port coupled to the negative pressure port and the check valve output port coupled to the pressure sense input.

13. The air circuit in claim 10 wherein, the pressure sense input is coupled to the negative pressure port by, a two state check valve having a check valve input port, a check valve output port, and a pressure actuator to allow unidirectional fluid flow in a first state, and deter fluid flow in a second state, the two state check valve added between the negative pressure port and the sensing port, wherein the check valve input port is coupled to the negative pressure port and the check valve output port is coupled to the pressure sensing port; the air circuit further comprising, a second pressure controllable two state valve having, a pressure actuator, an input port coupled to the positive pressure source, and an output port coupled to the negative pressure port; and a two state valve having, at least one actuator, an input port, and an output port, the input port coupled to the positive pressure source, the output port coupled to the pressure actuator of the two state check valve and the pressure actuator of the second pressure controllable two state valve.

14. The air circuit in claim 13 wherein, the output port of the second pressure controllable two state valve is coupled to the pressure sensing port by a pressure regulator.

15. The air circuit in claim 13 wherein, the actuator of the two state valve is selected from the group consisting of; a mechanical actuator, an electrical actuator, and a pressure actuator.

* * * * *